US008904937B2

(12) United States Patent
Mangolds et al.

(10) Patent No.: US 8,904,937 B2
(45) Date of Patent: Dec. 9, 2014

(54) LINE CHARGE

(71) Applicant: C-2 Innovations Inc., Stow, MA (US)

(72) Inventors: Arnis Mangolds, Stow, MA (US); Michael D. Farinella, Bolton, MA (US)

(73) Assignee: C-2 Innovations Inc., Stow, MA (US)

( * ) Notice: Subject to any disclaimer, the term of this patent is extended or adjusted under 35 U.S.C. 154(b) by 0 days.

(21) Appl. No.: 13/668,902

(22) Filed: Nov. 5, 2012

(65) Prior Publication Data

US 2014/0137760 A1 May 22, 2014

Related U.S. Application Data

(60) Provisional application No. 61/686,870, filed on Apr. 13, 2012.

(51) Int. Cl.

| | |
|---|---|
| ***F42B 3/00*** | (2006.01) |
| ***F42B 3/02*** | (2006.01) |
| ***F41H 11/14*** | (2006.01) |

(52) U.S. Cl.

CPC ... *F42B 3/00* (2013.01); *F42B 3/02* (2013.01); *F41H 11/14* (2013.01)

USPC ..... 102/320; 102/275.5; 102/324; 102/331; 102/332

(58) Field of Classification Search

CPC ..... F41H 11/14; F42B 3/00; F42B 3/02

USPC ..... 102/275.5, 275.9, 320, 322, 324, 325, 102/331, 332, 403; 89/1.13

See application file for complete search history.

(56) References Cited

U.S. PATENT DOCUMENTS

| | | | | |
|---|---|---|---|---|
| 2,455,354 | A * | 12/1948 | Bisch | 102/403 |
| 2,771,841 | A * | 11/1956 | De Fino | 102/403 |
| 3,354,826 | A | 11/1967 | Axelson et al. | |
| 3,374,737 | A * | 3/1968 | Pike | 102/275.5 |
| 3,724,319 | A * | 4/1973 | Zabelka et al. | 89/1.13 |
| 5,524,524 | A * | 6/1996 | Richards et al. | 89/1.13 |
| 5,959,233 | A | 9/1999 | Garcia et al. | |
| 6,205,903 | B1 * | 3/2001 | Woodall et al. | 89/1.13 |
| 6,253,450 | B1 | 7/2001 | Woodall et al. | |
| 6,321,630 | B1 * | 11/2001 | Woodall et al. | 89/1.13 |
| 6,439,099 | B1 | 8/2002 | Carlson et al. | |
| 7,000,545 | B2 * | 2/2006 | Sansolo | 102/331 |
| 7,104,176 | B2 | 9/2006 | Lowery et al. | |
| 7,162,943 | B1 | 1/2007 | Reitmeyer et al. | |

(Continued)

FOREIGN PATENT DOCUMENTS

| | | |
|---|---|---|
| CA | 577526 | 6/1959 |

OTHER PUBLICATIONS

International Search Report for PCT/US2013/033291; Jan. 2014.*

(Continued)

*Primary Examiner* — James S Bergin

(74) *Attorney, Agent, or Firm* — Iandiorio Teska & Coleman, LLP

(57) ABSTRACT

A line charge system includes a sock with a series of explosive sections and a detonation cord attached to each explosive section. A pair of spaced tubes made of explosive material are disposed about the line and secured to the explosive material of each section resulting in a hinged connection between each explosive section and the detonation cord.

23 Claims, 7 Drawing Sheets

(56) References Cited

U.S. PATENT DOCUMENTS

| | | | |
|---|---|---|---|
| 7,182,011 | B2 | 2/2007 | Lowery et al. |
| 7,296,503 | B1 | 11/2007 | McGrath |
| 7,299,735 | B2 | 11/2007 | Alford |
| 7,320,271 | B2 | 1/2008 | Hintz |
| 7,328,643 | B2 | 2/2008 | Goetsch et al. |
| 7,350,447 | B1 | 4/2008 | Smith |
| 7,363,124 | B1 | 4/2008 | Duarte |
| 7,437,986 | B2 | 10/2008 | Fuss et al. |
| 7,467,579 | B1 | 12/2008 | Portmann |
| 7,479,918 | B2 | 1/2009 | Johnson et al. |
| 7,481,144 | B2 | 1/2009 | Simula et al. |
| 7,484,447 | B1 | 2/2009 | Portmann |
| 7,493,843 | B2 | 2/2009 | Grosch et al. |
| 7,501,551 | B2 | 3/2009 | Eidelman et al. |
| 7,530,316 | B2 | 5/2009 | Blohm et al. |
| 7,536,170 | B2 | 5/2009 | Goldman et al. |
| 7,552,670 | B2 | 6/2009 | Goldman et al. |
| 7,600,460 | B2 | 10/2009 | Manders |
| 7,621,208 | B2 | 11/2009 | Huffman |
| 7,624,667 | B2 | 12/2009 | Kilkis |
| 7,637,196 | B2 | 12/2009 | Thornton |
| 7,658,149 | B2 | 2/2010 | Theobald et al. |
| 7,673,551 | B2 | 3/2010 | Meurer |
| 7,685,917 | B2 | 3/2010 | Reeves et al. |
| 7,698,981 | B2 | 4/2010 | Goldman et al. |
| 7,717,023 | B2 | 5/2010 | Pereira et al. |
| 7,726,244 | B1 | 6/2010 | Lloyd |
| 7,740,082 | B2 | 6/2010 | Davidson et al. |
| 7,752,953 | B2 | 7/2010 | Sokol et al. |
| 7,775,145 | B2 | 8/2010 | Bitar et al. |
| 7,775,146 | B1 | 8/2010 | Bitar et al. |
| 7,810,421 | B2 | 10/2010 | Hiza et al. |
| 7,814,821 | B2 | 10/2010 | Chenel |
| 7,836,811 | B1 | 11/2010 | Gardner et al. |
| 7,849,799 | B2 | 12/2010 | Pervan |
| 7,856,928 | B1 | 12/2010 | Paulic |
| 7,895,930 | B2 | 3/2011 | Fisk et al. |
| 7,913,624 | B2 | 3/2011 | Mitchell |
| 7,958,809 | B1 | 6/2011 | Bitar et al. |
| 7,984,668 | B2 | 7/2011 | Huffman |
| 7,987,760 | B1 | 8/2011 | Lundquist et al. |
| 8,006,620 | B2 | 8/2011 | Theobald et al. |
| 8,010,038 | B2 | 8/2011 | Valentine et al. |
| 8,037,797 | B1 | 10/2011 | Frank et al. |
| 8,047,135 | B1 | 11/2011 | Paulic et al. |
| 8,143,886 | B2 | 3/2012 | Huet et al. |
| 8,240,238 | B2 | 8/2012 | Willner |
| 8,240,239 | B1 | 8/2012 | Diaz |

OTHER PUBLICATIONS

'EBAD' Ensign-Bickford Aerospace & Defense, Small Projected Line Charge (SAPLIC),product sheet, (one (1) page).

Wikipedia.org/wiki/mine-clearing_line_charge, Mine-clearing line charge, printed Sep. 12, 2012, three (3) pages.

Written Opinion of the International Searching Authority for PCT Application No. PCT/US2013/033291 mailed Jan. 14, 2014 (five (5) pages).

* cited by examiner

LINE CHARGE

APPLICATIONS

This application claims benefit of and priority to U.S. Provisional Application Ser. No. 61/686,870 filed Apr. 13, 2012 under 35 U.S.C. §§119, 120, 363, 365, and 37 C.F.R. §1.55 and §1.78 and is incorporated herein by this reference.

FIELD OF THE INVENTION

The invention relates to line charges and use for demolition, breaching, obstacle clearing, unexploded ordnance (UXO) reduction and other tasks.

BACKGROUND OF THE INVENTION

Line charges can be used to clear buried mines, expose improvised explosive devices, breach walls or fences, or the like. Some line charges are heavy, complex and difficult to manufacture and deploy. Some are deployed by a rocket.

Line charges typically include spaced explosive charges connected via a detonation cord. U.S. Pat. No. 6,439,099, incorporated herein by this reference, discloses spaced cylindrical charges and a detonation cord within a yarn structure.

SUMMARY OF THE INVENTION

Needed is a lightweight and effective line charge system. The invention features. in one embodiment, flat explosive sections spaced apart in a flexible sock (which can be easily coupled to another line charge segment) and configured so that when deployed (e.g., hand thrown) all the explosive sections lie flat on the ground and conform thereto. The hinge connection between the detonation cord and the each explosive section, which enables them to lie flat, is preferably made of explosive material. The result, in one preferred embodiment, is a lighter line charge which lies flat on and conforms to the ground to better couple explosive energy into the ground.

Featured is a line charge system comprising a series of explosive sections, a line hingedly attached to each explosive section, and at least one detonation connection between the line and each explosive section. In one example, the detonation connection includes a pair of spaced tubes made of explosive material disposed about the line. Each explosive section may include an explosive slab. The pair of spaced tube may be adjacent an edge of the slab. In one example, the detonation connection further includes an explosive tape securing each tube to the explosive slab. The system may further include a tray for the explosive slab and the spaced tubes and typically the explosive slab is secured to the tray.

In some examples, the explosive slab includes a fast propagation velocity material and the line is detonation cord. The system usually also includes a flexible sock housing the series of explosive sections. In one design, the sock includes spaced internal pockets for the explosive sections. One or more of the pockets may further include shrapnel. One featured sock includes one or more ties, a quick release closure, and a fastener at at least one end for connection to another sock.

Also featured is a line charge system comprising a series of explosive sections including an explosive slab and at least one explosive hinge member adjacent the explosive slab. A detonation cord interconnects the explosive sections and is associated with the explosive hinge member. A flexible sock houses the series of explosive sections and the detonation cord.

One line charge system includes a series of explosive sections with an explosive body, at least one explosive hinge member adjacent the explosive body, and a tray for the explosive body. A detonation cord is hingedly attached to each explosive section via the explosive hinge member and a flexible sock houses the series of explosive sections and the detonation cord.

The subject invention, however, in other embodiments. need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
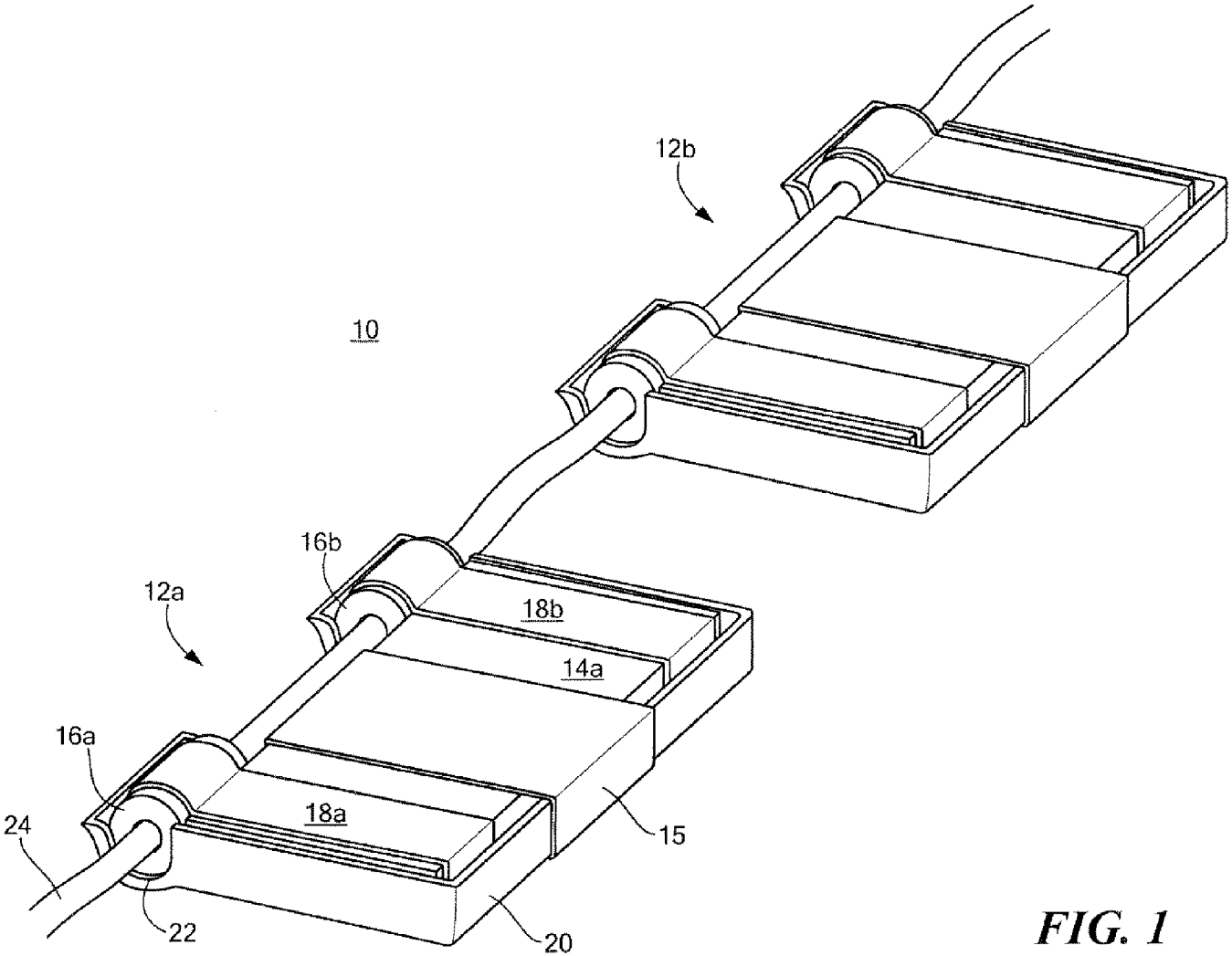
FIG. 1 is a schematic three dimensional top view showing a portion of a line charge system segment in accordance with one preferred version of the invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows a line charge system 10 with a series of explosive sections 12*a* and 12*b*. Typically, there are seven or more explosive sections each spaced three inches apart. A five foot line charge segment may weight as little as 2.0 lbs. The segment length can vary. A typical line charge is 0.5" thick and 1.7" wide. Line charge segments can be physically and explosively secured together in the field to result in line charges 7-35 feet in length or more. The line charge can be easily packed, transported, and hand thrown (or hand unrolled), robotically pulled out or propelled out.

Each explosive section, in one particular design, includes slab 14*a* of explosive material (e.g., RDX—a fast propagation velocity plastic explosive). Slab 14*a* may be 0.25" thick by 1.5" wide by 5" long.

Adjacent to one edge of explosive slab 14*a* are one or more hinge members such as spaced tubes 16*a* and 16*b* shown in FIG. 1 in one example in contact with the left edge of slab 14*a* and coupled thereto using explosive tapes 18*a* and 1 8*b* which may be pressed onto and around slab 14*a*, adhered thereto (using, for example, an adhesive), or covered with another type of tape. "Booster" tubes 16*a* and 16*b* may be made of RDX or PETN explosive material (a slow propagation velocity plastic explosive). Tapes 18*a* and 18*b* may be sheets of RDX or PETN material.

Note that in this preferred embodiment, the hinge(s), the slab, and tape is made of explosive material so structurally most of each section is explosive for weight efficiency.

Figure 2:
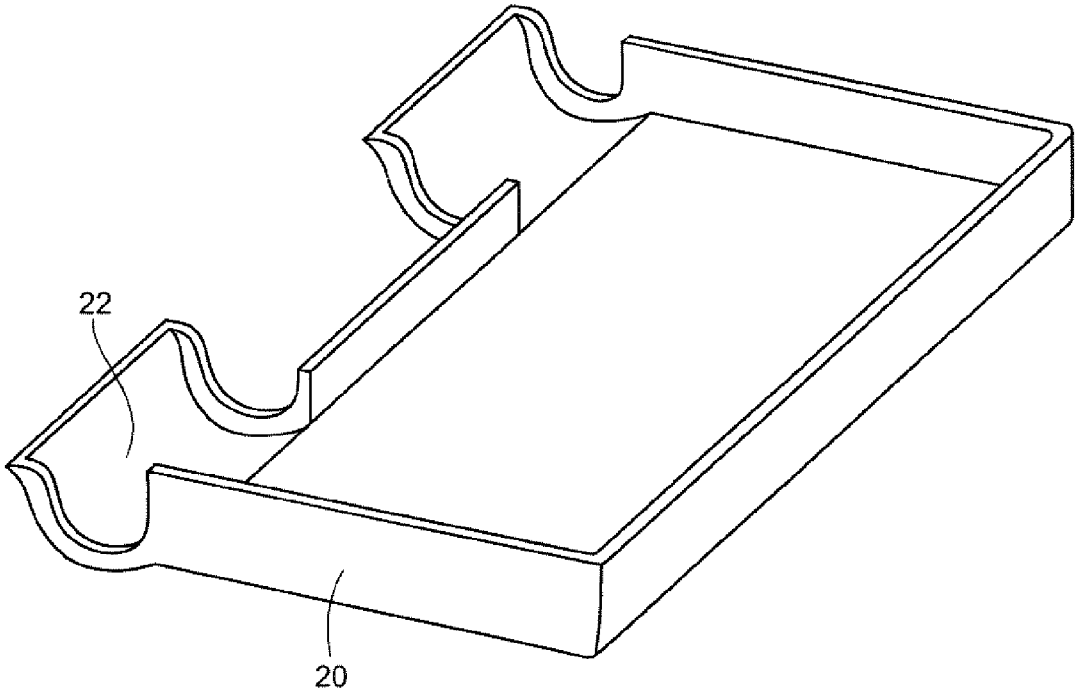
FIG. 2 is a schematic three dimensional top view of the plastic tray of the line charge system of FIG. 1.

Plastic tray 20 is provided to provide rigidity to each explosive section and includes cradles (as shown at 22) for the tubes. Plastic tray 20 is also shown in FIG. 2.

In this preferred embodiment, line 24 (e.g., detonation cord) is hingedly attached to each explosive section by running line 24 through the hinge tubes 16*a* and 16*b* of each explosive section and providing clearance between the outer diameter of the line and the inner diameter of each tube. In this way, each explosive charge 14 is urged to lie flat after it is thrown and therefore more effectively couples explosive energy into the ground. One or more charges may land edge wise but the hinge connection to line 24, the curvature of tubes 16*a* and 16*b*, and the curved cradles (as shown at 22) along with gravity urge the charges to all lie flat.

Note the detonation connection between detonation cord 24 and explosive charge 14 preferably includes the explosive material of tubes 16 and tape 18. Regular (non-explosive) tape 15 can be used to secure each explosive charge 14 in tray 20. An adhesive could also be used.

Figure 3:
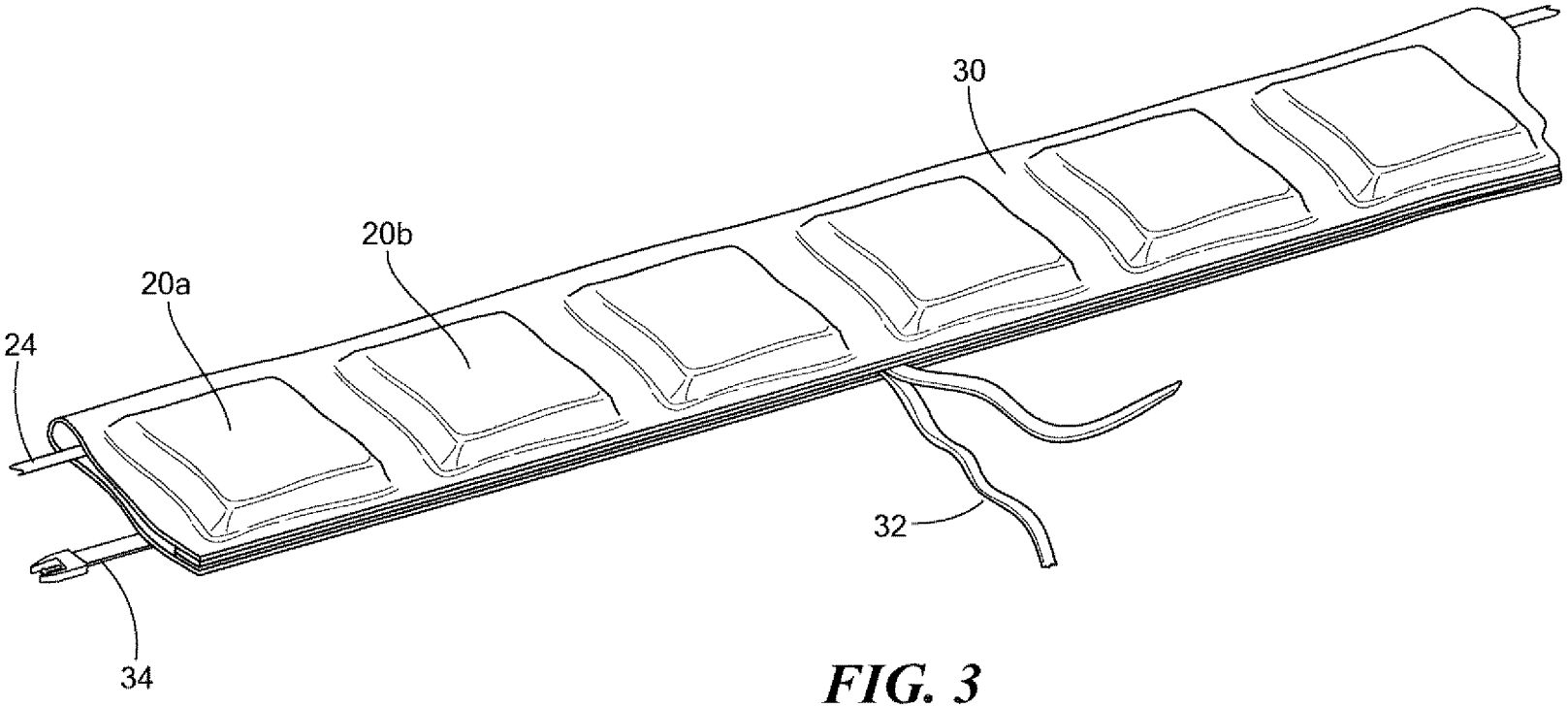
FIG. 3 is a schematic three dimensional top view showing a series of explosive sections housed in a sock member.
Figure 4:
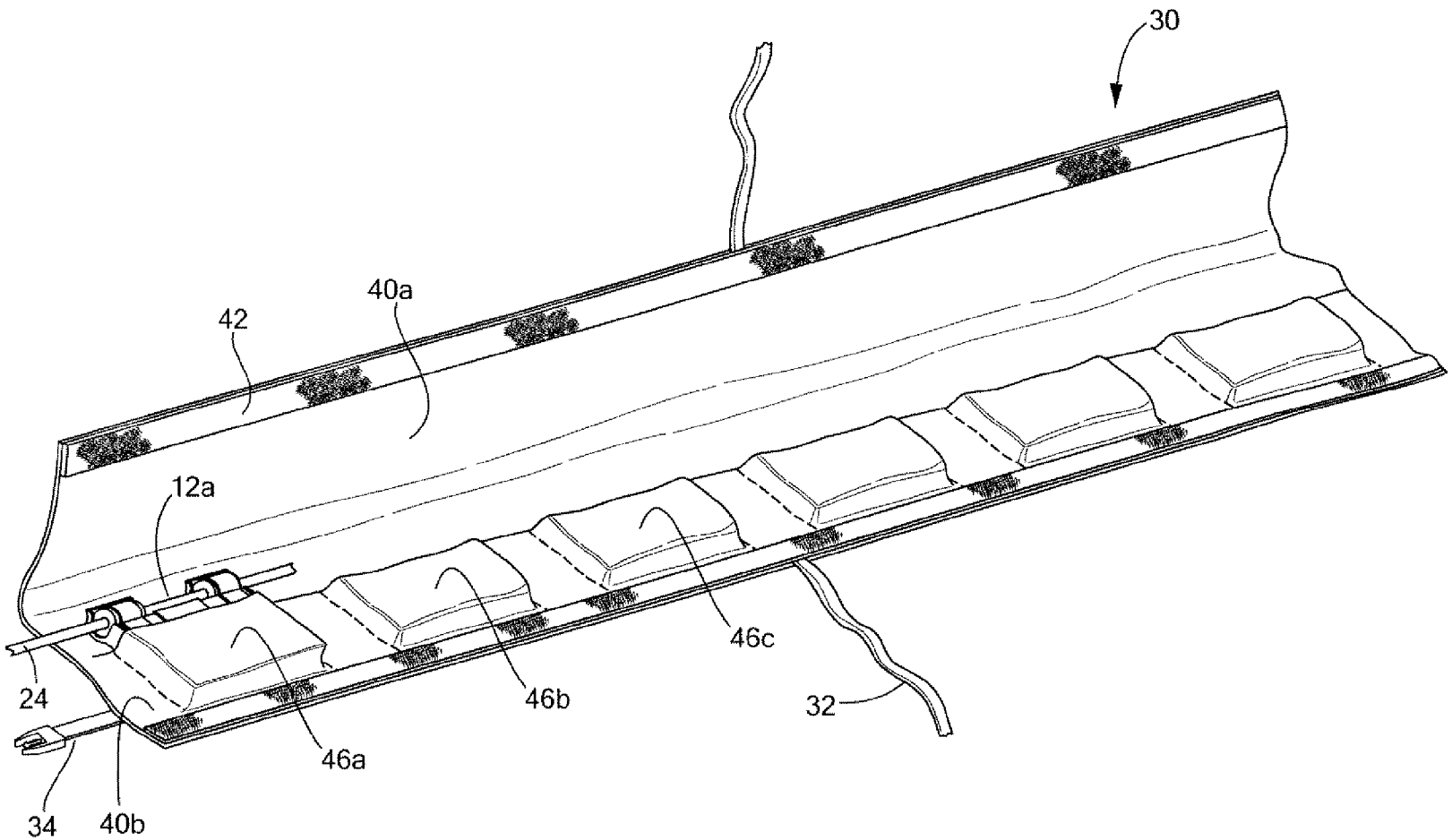
FIG. 4 is a schematic three dimensional front view showing the interior of the sock member of FIG. 3.

Flexible sock 30, FIG. 3-4, is typically included to house the series of explosive sections. The explosive sock can be made of cloth such as nylon or polyester and typically includes top 40*a* and bottom 40*b* panels sewn together on one edge and open and closed edgewise via velcro 42 or another type of quick release fastener or closure running along the inside of each edge of the panel. One panel includes spaced internal pockets 46*a*, 46*b*, 46*c*, and the like for the explosive sections. This retains the spacing between the sections when the line charges are deployed. Shrapnel such as buck shot or the like can be added on top of each RDX slab. The buck shot can be placed in a tray with individual cavities for each shot piece.

Figure 5:
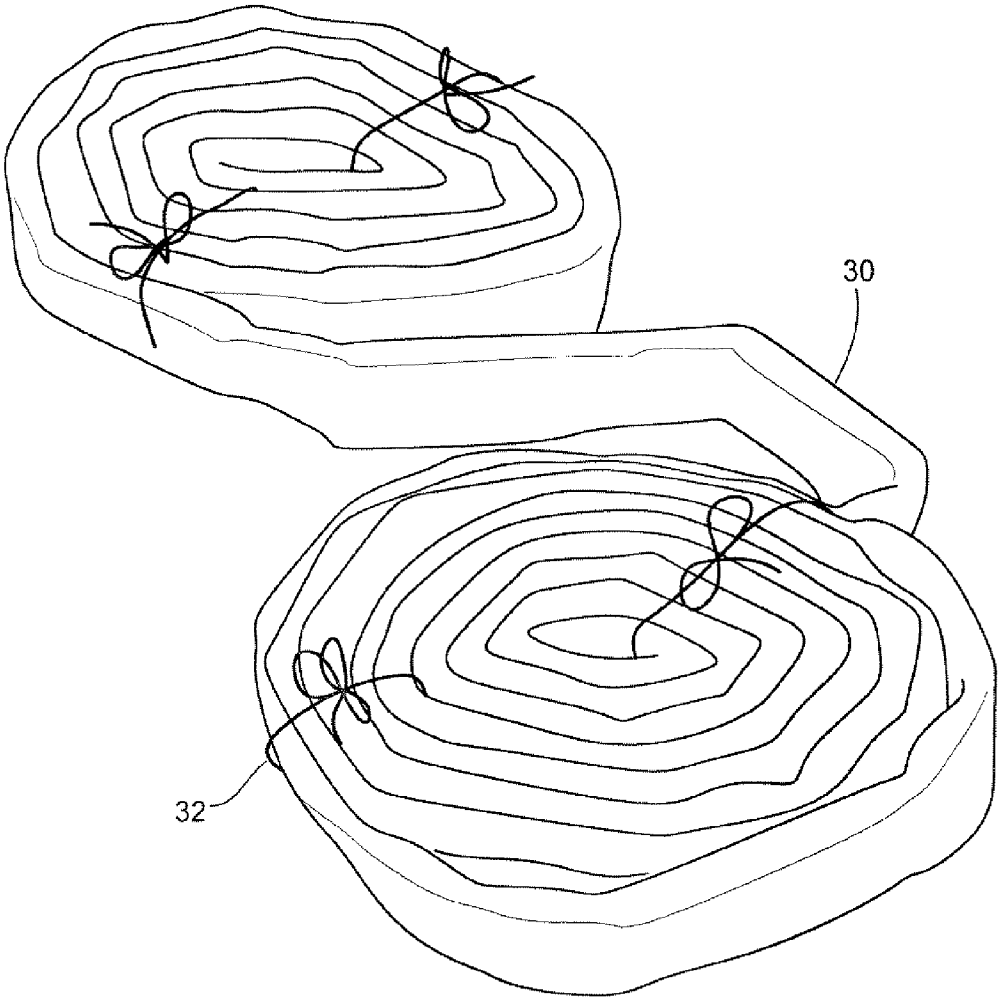
FIG. 5 is a schematic three dimensional top view showing a line charge coiled for packaging and transport in accordance with an example of the invention.
Figure 6:
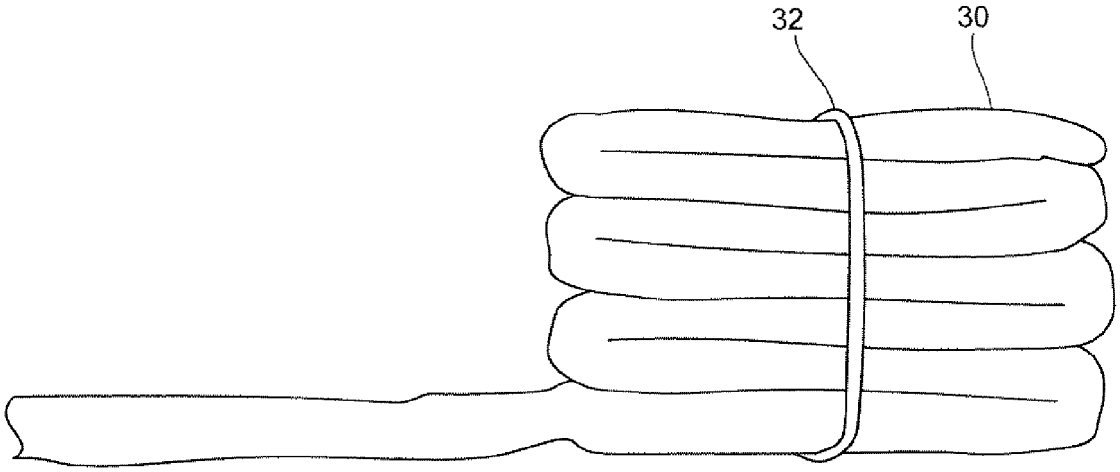
FIG. 6 is a schematic view showing a line charge segment packaged by stacking in accordance with another example of the invention.

Ties as shown at 32 can be included periodically along the length of the sock to tie it into a rolled (FIG. 5) or stacked (FIG. 6) configuration (accordion style). The ties can also be used to double up a given segment making it twice as wide or thick for a particular deployment. The ties can also be used to secure a segment to a fence or around a tree, for example. End fastener members as shown at 34, FIGS. 3-4 can be included to couple segments together. Two quick release fasteners are preferred such as clips. The detonation cord of one segment can be coupled to the detonation cord of another segment by tying a knot or using standard junction clips.

Figure 7:
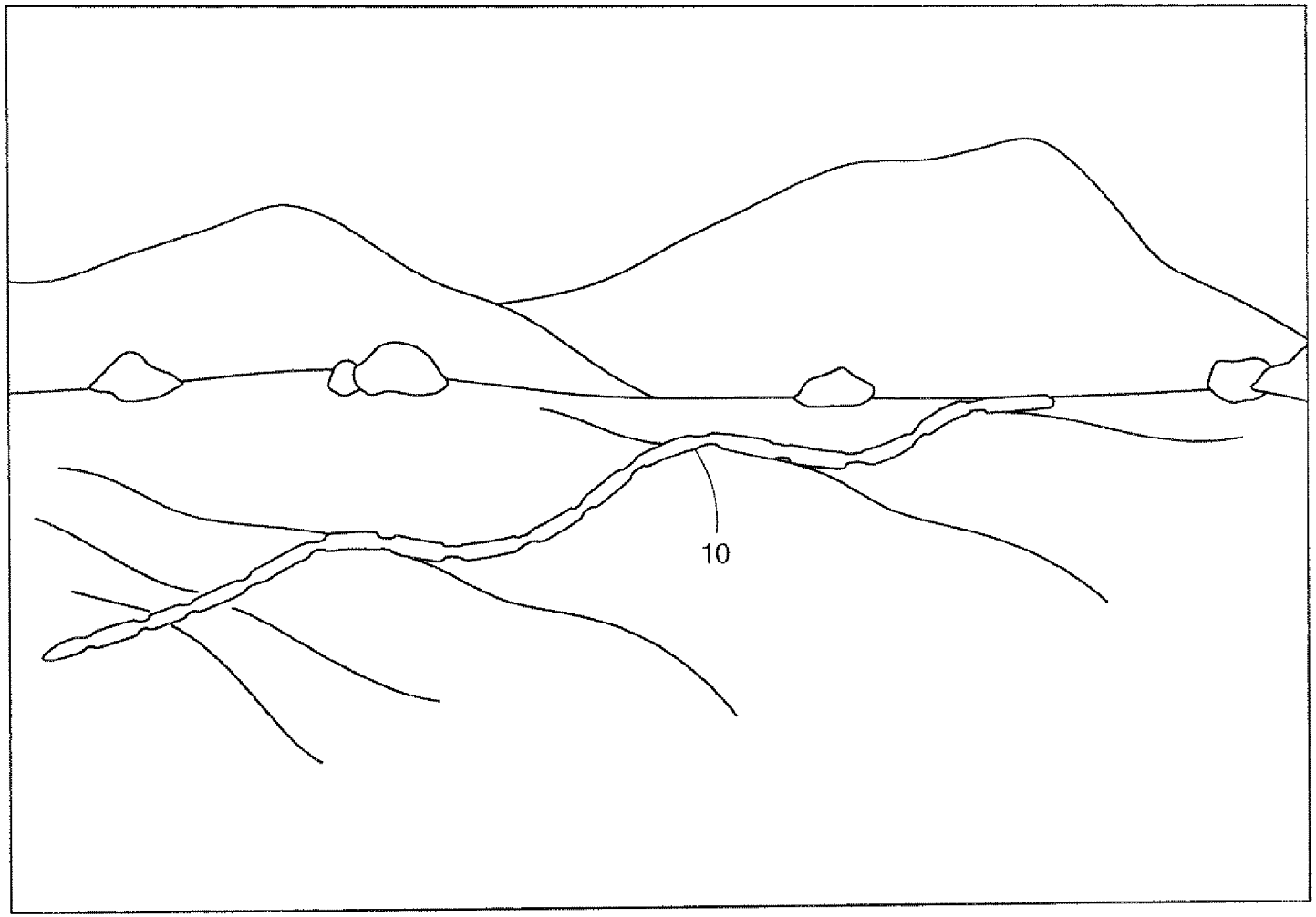
FIG. 7 is a schematic view showing a line charged deployed and conforming to the terrain in accordance with one aspect of the invention.

FIG. 7 shows how the line charge system lies flat and conforms to the terrain when it is deployed. In one experiment, a 35 foot long line charge weighed 14 pounds and was ground conformable to maximize ground coupling and transfer the pressure pulse to achieve the most efficient soil throw in order to expose buried improvised explosive devices, pressure plates, or command wires. In some designs, a built in tension line can be incorporated into the protective sock to take all the suspension and shock loads During testing, one line charge created an 11 inch deep trench 11-13 inches wide.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A line charge system comprising:

a series of explosive sections;

a line hingedly attached to each explosive section, wherein the line includes a major axis and each explosive section is adapted to rotate about the major axis; and at least one detonation connection connected between the line and each explosive section, the detonation connection including a tube made of explosive material disposed about the line and having a major axis substantially coincident with the major axis of the line.

2. The system of claim 1 in which the detonation connection includes a pair of spaced tubes made of explosive material disposed about the line.

3. The system of claim 2 in which each explosive section includes an explosive slab and the pair of spaced tube are adjacent an edge of said slab.

4. The system of claim 3 in which the detonation connection further includes an explosive tape securing each tube to the explosive slab.

5. The system of claim 3 further including a tray for the explosive slab and the spaced tubes.

6. The system of claim 5 in which the explosive slab is secured to the tray.

7. The system of claim 3 in which the explosive slab includes a fast propagation velocity material.

8. The system of claim 1 in which the line is detonation cord.

9. The system of claim 1 further including a flexible sock housing said series of explosive sections.

10. The system of claim 9 in which said sock includes spaced internal pockets for the explosive sections.

11. The system of claim 10 in which one or more of said pockets further includes shrapnel.

12. The system of claim 9 in which the sock includes one or more ties.

13. The system of claim 9 in which the sock includes a quick release closure.

14. The system of claim 9 in which the sock includes a fastener at one end for connection to another sock.

15. The system of claim 14 in which said fastener includes a snap type fastener.

16. A line charge system comprising:

a series of explosive sections including:

an explosive slab:

a rigid member including a plastic tray for the explosive slab and an explosive hinge member;

and at least one explosive hinge member adjacent the explosive slab;

a detonation cord interconnecting the explosive sections and associated with the explosive hinge member; and a flexible sock housing the series of explosive sections and the detonation cord.

17. The system of claim 16 in which each explosive section includes an explosive tape between the explosive hinge member and the explosive slab.

18. The system of claim 16 in which said sock includes spaced internal pockets for the explosive sections.

19. The system of claim 18 in which one or more of said pockets further includes shrapnel.

20. The system of claim 18 in which the sock includes one or more ties.

21. The system of claim 18 in which the sock includes a quick release closure.

22. The system of claim 18 in which the sock includes a fastener at one end for connection to another sock.

23. A line charge system comprising:

a series of explosive sections including:

an explosive body, at least one explosive hinge member adjacent the explosive body, and a tray for the explosive body;

a detonation cord hingedly attached to each explosive section via said explosive hinge member, wherein the detonation cord includes a major axis and each explosive section is adapted to rotate about the major axis of the detonation cord; and a flexible sock housing a series of explosive sections and the detonation cord.

* * * * *